United States Patent [19]

Morii et al.

[11] Patent Number: 5,058,517

[45] Date of Patent: Oct. 22, 1991

[54] WORKPIECE FOLDING DEVICE FOR A SEWING MACHINE

[75] Inventors: Satoshi Morii, Nagoya; Kunihiko Murata, Tsushima; Hiroyuki Mitsui, Kasugai; Toshiaki Iwasaki, Nagoya, all of Japan

[73] Assignee: Brother Kogyo Kabushiki Kaisha, Japan

[21] Appl. No.: 490,997

[22] Filed: Mar. 9, 1990

[30] Foreign Application Priority Data

Mar. 14, 1989 [JP] Japan ..... 1-28621[U]

[51] Int. Cl.[5] ..... D05B 21/00; D05B 35/00

[52] U.S. Cl. ..... 112/121.15; 112/147; 223/38

[58] Field of Search ..... 112/121.15, 121.12, 112/121.11, 104, 147, 141, 262.3, 265.1; 223/38

[56] References Cited

U.S. PATENT DOCUMENTS

| | | | |
|---|---|---|---|
| 3,699,907 | 10/1972 | Anderson et al. | 112/121.27 |
| 4,821,659 | 4/1989 | Morii et al. | 112/147 X |
| 4,951,585 | 8/1990 | Haneda et al. | 112/104 X |
| 4,967,675 | 11/1990 | Goldbeck et al. | 112/104 X |

FOREIGN PATENT DOCUMENTS 6391275 6/1988 Japan .

2217739A 11/1989 United Kingdom .

*Primary Examiner*—Peter Nerbun

*Attorney, Agent, or Firm*—Oliff & Berridge

[57] ABSTRACT

A workpiece folding device for a sewing machine which can fold the peripheral edge of a fabric such as pocket cloth, comprising a gage plate on which the pocket cloth is placed, a press plate superimposed on the gage plate for folding down the edge of the cloth along the contour of the gage plate, a folding-pieces support member surrounding the periphery of the gage plate, a plurality of folding pieces provided on the folding-pieces support member and shifted between two positions: an operational position under the gage plate for folding down the peripheral edge of the cloth and a preparatory position apart from the gage plate, and a plurality of pinching pieces for pinching the gage plate, the cloth and the press plate in cooperation with the corresponding folding pieces in the operational position. In this workpiece folding device, the distance between the folding pieces and the gage plate is appropriately kept and thus the pocket cloth is neatly folded even if the positions of the folding pieces are roughly adjusted. Consequently, the workpiece folding device for the sewing machine saves the operator the tedious task of minutely regulating the positions of the folding pieces.

8 Claims, 5 Drawing Sheets

WORKPIECE FOLDING DEVICE FOR A SEWING MACHINE

BACKGROUND OF THE INVENTION

This invention relates to a workpiece folding device for a sewing machine which can form a fold along the peripheral edge of a workpiece.

As a method for forming a fold along the peripheral edge of a workpiece, Japan Published Unexamined Utility Model Application No. 63-91275 is proposed by the same applicant as that of the present invention. As shown in FIG. 5A, a pocket cloth P is placed on a gage plate 24, a press plate 28 covers the gage plate 24 together with the pocket cloth P, and the peripheral edge of the pocket cloth P is bent down along the contour of the gage plate 24. Subsequently, as shown in FIG. 5B, a plurality of folding pieces 35 supported on a folding-pieces support member 32 are moved from the side of the gage plate 24 to the underside of the gage plate 24 by air cylinders 33. The peripheral edge of the pocket cloth P is thus folded. In this prior-art device, the distance T between the gage plate 24 and each of the folding pieces 35, both of which are positioned above a table 14, is adjusted before the folding operation.

However, the prior-art device has problems when the distance T between the gage plate 24 and each of the folding pieces 35 is considerably short or long.

When the distance T is too long, the folding pieces 35 are positioned below the folding-pieces support member 32. After the pocket cloth P is folded at its periphery, the gage plate 24, the folding pieces 35 and the pocket cloth P are pressed onto the table 14 all together. Then, so large load is applied to the folding pieces 35 that the folding pieces 35 may be deformed or broken. After that, when the folding pieces 35 are detached from the gage plate 24, the folded edge of the pocket cloth P may be bulged out of the gage plate 4. Thus, it is difficult for the prior-art device to form a beautiful fold.

When the distance T is too short, the folding pieces 35 may push up the peripheral edge of the gage plate 24 or bump the gage plate 24 via the pocket cloth P, thus hurting the gage plate 24. Further, during the withdrawal of the folding pieces 35, folded peripheral edge of the pocket cloth P may be pulled out of the gage plate 24 due to the frictional force between the pocket cloth P and the folding pieces 35.

In addition, it is time-consuming and tedious operation to adjust a plurality of the folding pieces 35 in a way that the distance T between the gage plate 24 and each of the folding pieces 35 are uniform.

SUMMARY OF THE INVENTION

It is an object of the present invention to provide a workpiece folding device for a sewing machine which can form a neat fold and keep the distance between the gage plate and the folding pieces uniform without tedious operation for minutely adjusting the positions of the folding pieces before the folding operation.

This object is realized by a workpiece folding device for a sewing machine of the invention which comprises a gage plate on which a cloth is placed, a press plate which is superimposed on the gage plate for folding down the peripheral edge of the cloth along the contour of the gage plate, a folding-pieces support member surrounding the gage plate, a plurality of folding pieces that are provided on the folding-pieces support member and is shifted between two positions: an operational position under the gage plate for folding down the peripheral edge of the cloth, and a preparatory position apart from the gage plate, and a plurality of pinching pieces for pinching the gage plate, the cloth and the press plate all together in cooperation with the corresponding folding pieces in the operational position.

BRIEF DESCRIPTION OF THE DRAWINGS

By way of example and to make the description more clear, reference is made to the accompanying drawings in which.

DETAILED DESCRIPTION OF PREFERRED EMBODIMENTS

Set forth is an explanation of a preferred embodiment of the present invention with reference to the attached drawings FIGS. 1 through 4E.

Figure 3:
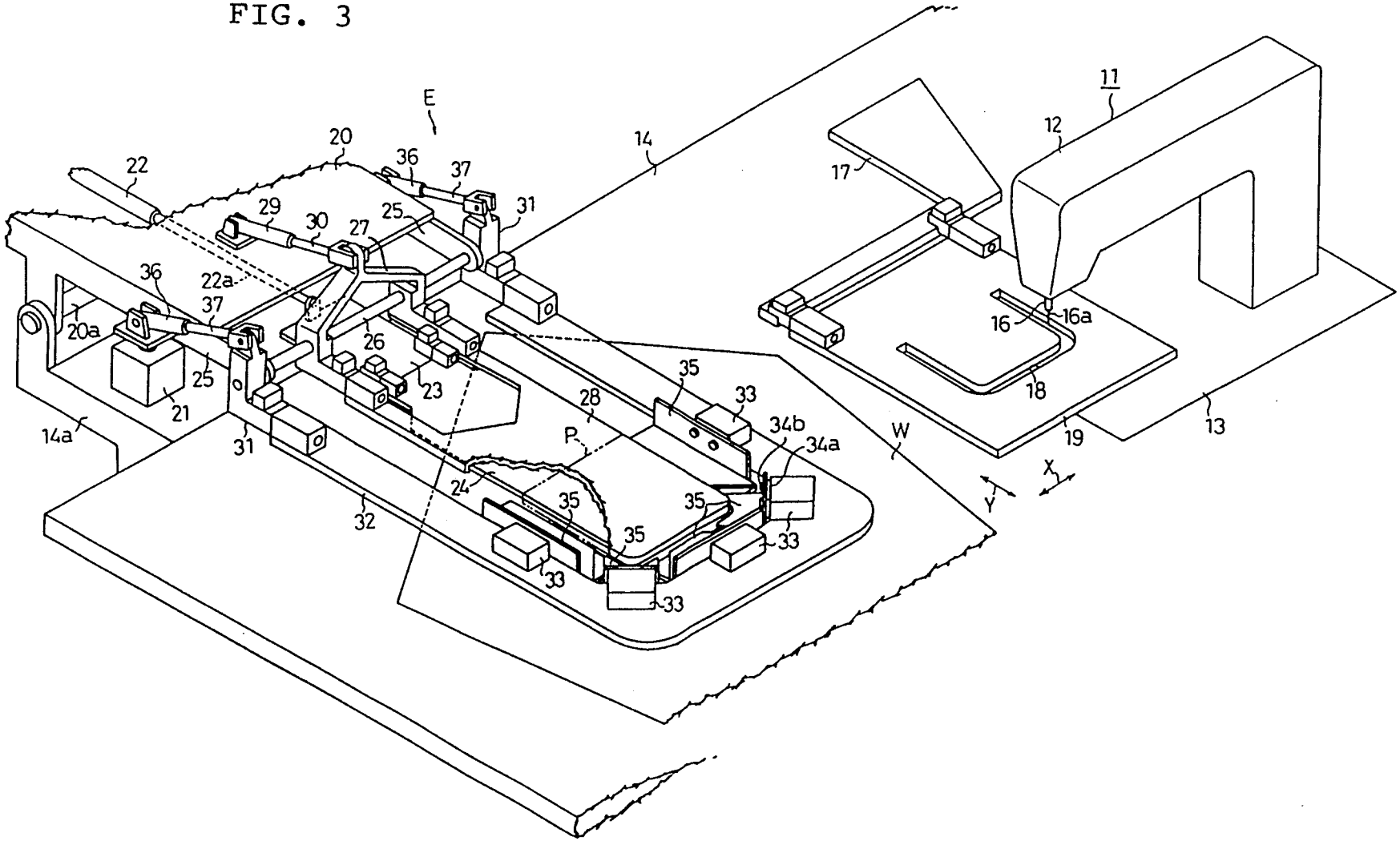
FIG. 3 is a perspective view of the apparatus shown in FIG. 1 embodiment.

As shown in FIG. 3, a sewing machine 11 provided on a table 14 comprises an arm 12 and a bed 13. A needle bar 16 and a needle 16*a* attached to the end of the needle bar 16 are supported on the arm 12. In the bed 13 a loop taker (not shown) is positioned. The loop taker and the needle 16*a* compose an apparatus for loop formation.

A feed arm 17 provided on the table 14 is allowed to move in the directions X and Y as shown in FIG. 3. On the front end of the feed arm 17, a feed plate 19, on which a needle guide groove 18 is formed, is detachably attached. A fabric W of a front body or the like and the pocket cloth P to be sewn on the fabric W are pressed onto the table 14 by the feed plate 19.

A base 14*a* is formed on the rear end of the table 14. A support member 20 rotatably supported on a support shaft 20*a* is operated by an air cylinder 21 provided on the base 14*a*. The end of a piston 22*a* of an air cylinder 22 is connected to a gage-plate support member 23. A gage plate 24, detachably attached to the front end of the gage-plate support member 23, functions as a support plate on which the pocket cloth P is placed, and also defines the contour of the pocket cloth P.

A support shaft 26 is laid between a pair of shaft support members 25 projecting from the support member 20. A press-plate support member 27 is rotatably supported on the support shaft 26. A press plate 28 is detachably attached to the front end of the press-plate support member 27, and a piston 30 of an air cylinder 29 provided on the support member 20 is connected to the press-plate support member 27.

Both ends of an almost U-shaped folding-pieces support member 32 are detachably attached to a pair of support blocks 31. The pair of support blocks 31 rotates on the support shaft 26. On the folding-pieces support member 32, five air cylinders 33 are positioned along the periphery of the press plate 28. A fixture 34*a* is provided on the end of a piston 34 of each of the air cylinders 33. Each of the vertically extending parts of the folding pieces 35 has a pair of vertically long holes 35*a*. The folding pieces 35 are screwed onto the fixtures 34*a* via screws 34*b* through the long holes 35 and their positions are vertically regulated.

The rear ends of a pair of air cylinders 36 and pistons 37 provided on the tops of the pair of support blocks 31 are rotatably connected to the support member 20. The air cylinders 21, 22, 29, and 36 compose a drive apparatus E for operating the gage plate 24, press plate 28, and folding-pieces support member 32 in relation to the table 14.

Figure 4A:
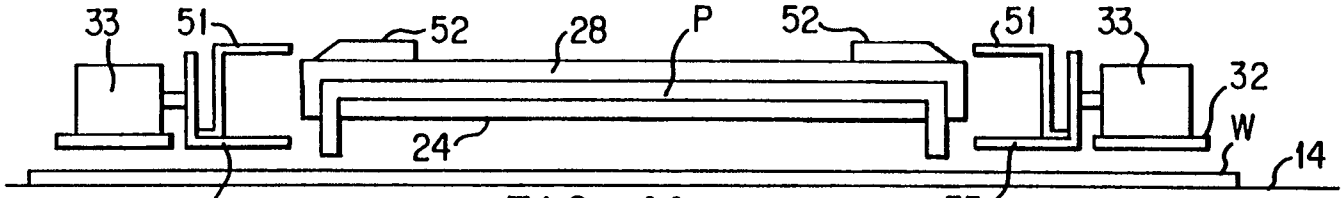
FIGS. 4A through 4E are illustrations showing a folding operation of the embodiment.
Figure 4B:
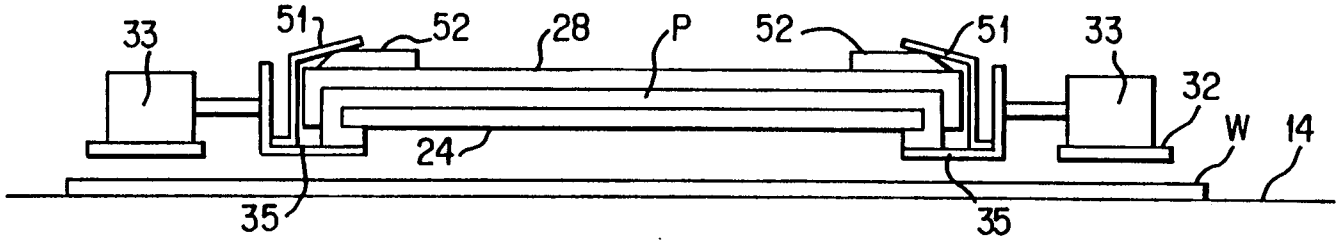

The pocket cloth P is sewn on the fabric W by means of the workpiece folding device for a sewing machine as implemented in the apparatus of FIG. 3 as follows:

As shown in FIG. 4A, when the press plate 28 is superimposed on the gage plate 24 by the drive apparatus E, the peripheral edge of the pocket cloth P is bent down. Then the folding pieces 35 shift to the underside of the gage plate 24, pushing the bent edge of the pocket cloth P inward, as shown in FIG. 4B.

Figure 4C:
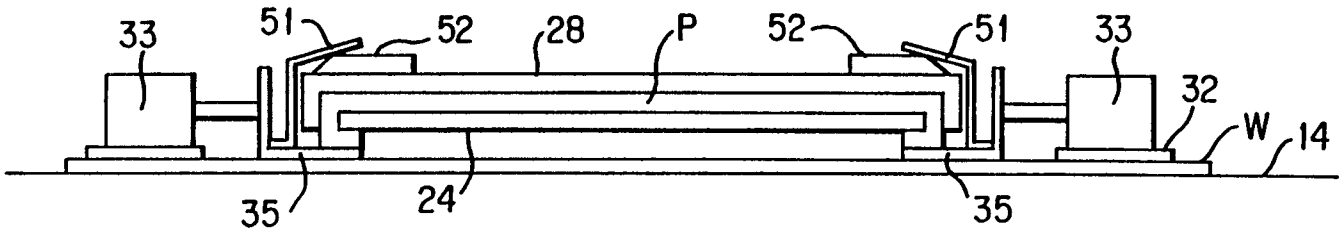
Figure 4D:
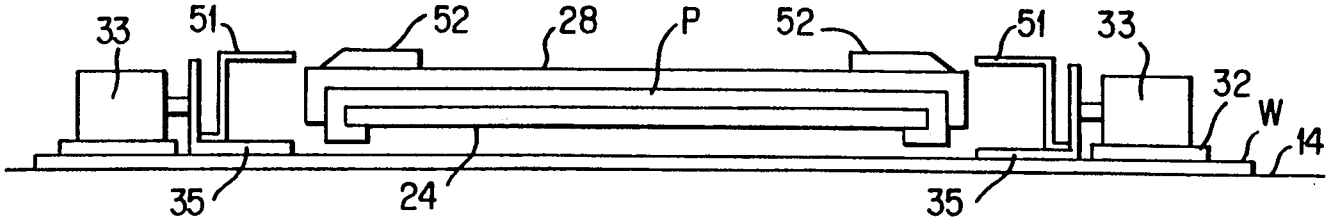
Figure 4E:
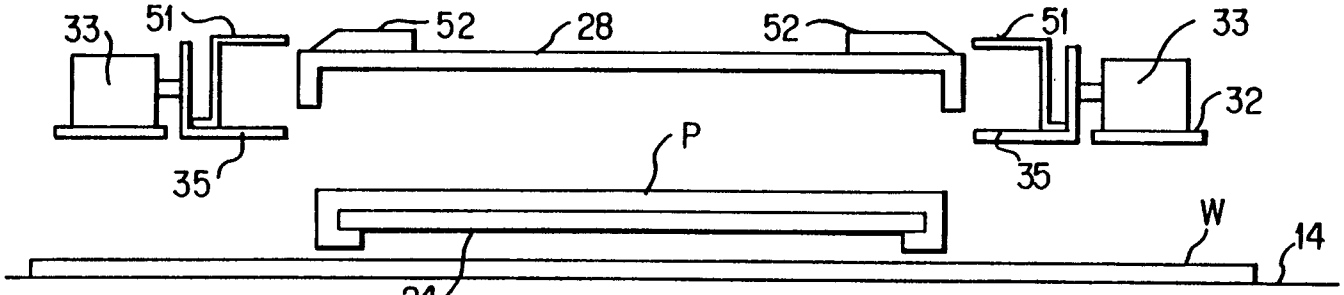
Figure 5A:
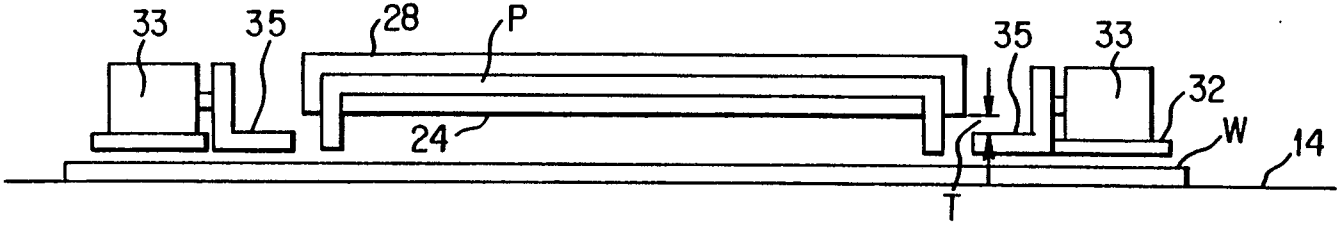
FIG. 5A PRIOR ART
FIGS. 5A and 5B show prior art apparatus.
Figure 5B:
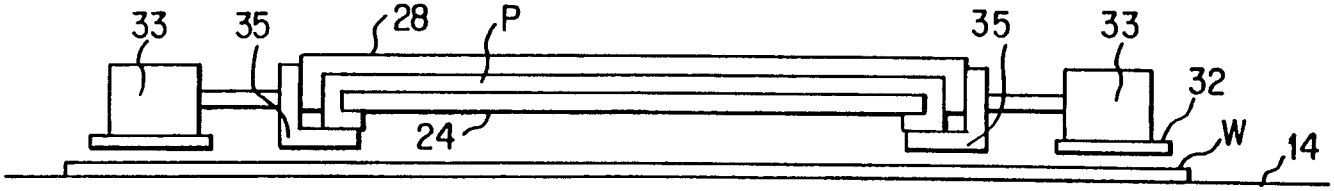
FIG. 5B PRIOR ART

Subsequently, the drive apparatus E lowers the gage plate 24, the press plate 28, the folding-pieces support member 32, by operating the support member 20, as shown in FIG. 4C. After the folding pieces 35 are removed from the pocket cloth P as shown in FIG. 4D, the folding-pieces support member 32 and the press plate 28 are raised and detached from the pocket cloth P, as shown in FIG. 4E.

Next, the pocket cloth P is pressed onto the fabric W together with the gage plate 24 by the feed plate 19. The air cylinder 22 removes the gage plate 24 from the pocket cloth P via a piston 22*a*. The feed plate 19 is then shifted such that the end of the needle guide groove 18 is positioned right under the needle 16*a*. Under such condition, the sewing machine 11 sews the pocket cloth P on the fabric W moving the feed plate 19 in the directions X and Y.

The construction of the mechanism for folding the pocket cloth P is explained below.

Figure 1:
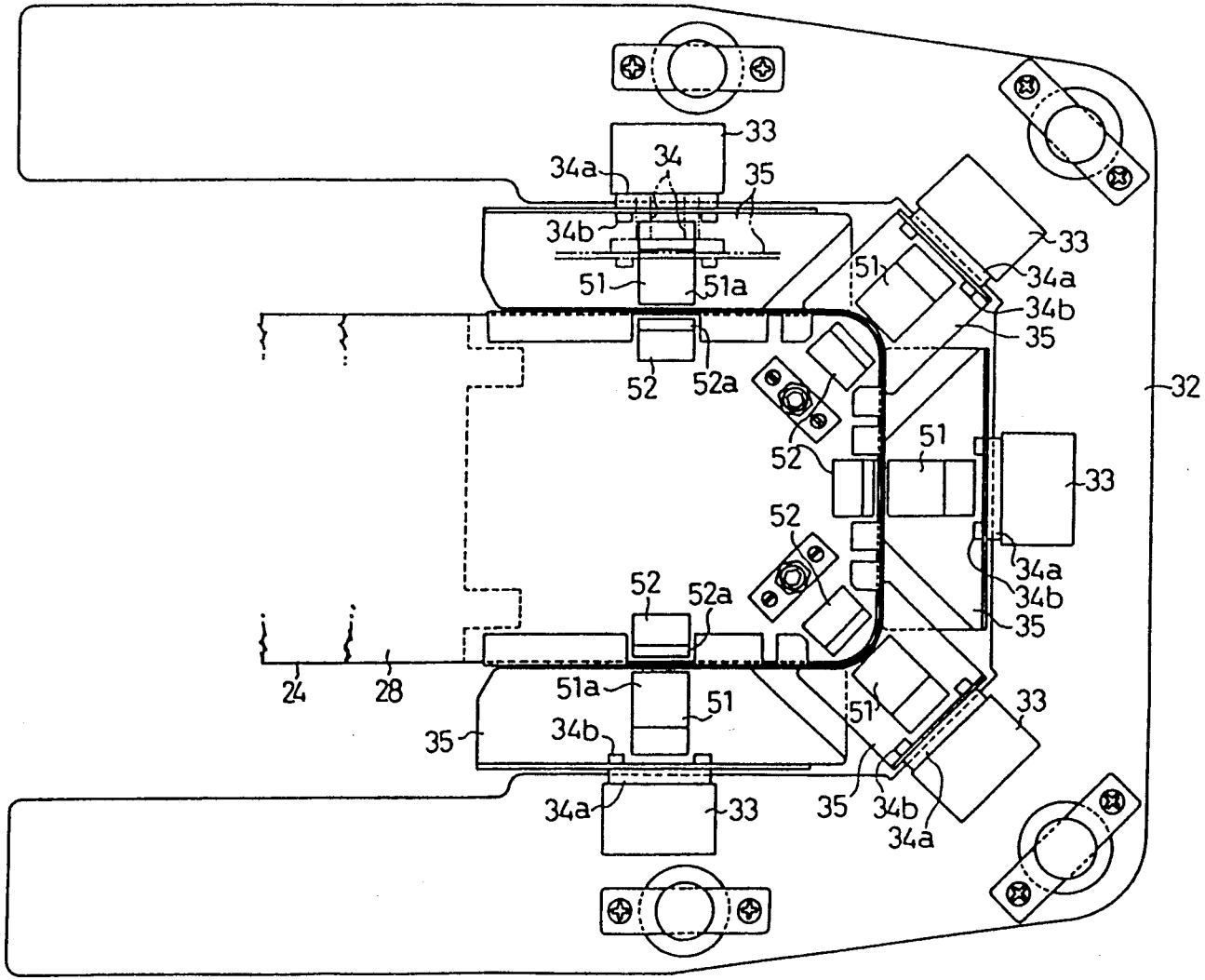
FIG. 1 is a plan view of an embodiment of a workpiece folding device for a sewing machine of the present invention.
Figure 2:
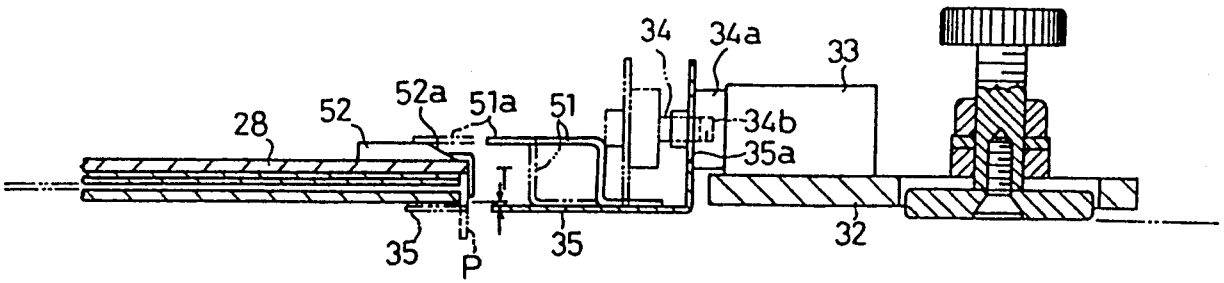
FIG. 2 is an enlarged cross-sectional view of the embodiment.

As shown in FIGS. 1 and 2, a pinching piece 51 formed in an almost L-shape from elastic material is fixed on each of the folding pieces 35 by welding. The pinching piece 51 is provided with a pinching portion 51*a* for pinching the press plate 28, the pocket cloth P and the gage plate 24 in cooperation with the corresponding folding piece 35. Opposite to each of the pinching pieces 51, a receiving piece 52 made of synthetic resin is attached on the upper surface of the press plate 28. On the outer end of the receiving piece 52, an inclined guide face 52*a* is formed so as to taper toward the end. The inclined guide face 52*a* engages with the pinching portion 51*a* of the pinching piece 51.

As shown in FIG. 2, after the positions of the folding pieces 35 are roughly adjusted and the distance T between the folding piece 35 and the gage plate 24 is set longer than the thickness of the pocket cloth P, the air cylinders 33 shift the folding pieces 35 from the preparatory position to the operational position. The pinching portion 51*a* of the pinching pieces 51 then engages with the inclined guide face 52*a* of the receiving pieces 52.

When the folding pieces 35 are shifted from the preparatory position to the operational position, the pinching portions 51*a* of the pinching pieces 51 are pushed upward along the inclined guide faces 52*a*. Thus means are provided to increase the pinching force as the pinching means moves towards the operational position and to decrease the pinching force as the pinching means moves towards the preparatory position. The folding pieces 35 are bent with the pinching pieces 51 against the elasticity of the folding pieces 35. Consequently, when the folding pieces 35 are in the operational position, the press plate 28, the pocket cloth P, and the gage plate 24 are pinched between the pinching pieces 51 and the folding pieces 35. The distance T disappears and the edge of the pocket cloth P is securely folded down along the contour of the gage plate 24.

When both the folding pieces 35 and the pinching pieces 52 are returned to the preparatory position, the pinching pieces 51 are pulled down along the inclined guide face 52*a* of the receiving pieces 52 and the folding piece 35 and the pinching pieces 51 regain their original shapes due to their elasticity. Since the distance T is gradually widened to the original width, the folded portion of the pocket cloth P is never bulged out by the folding piece 35.

As described above, in this embodiment the folding pieces 35 and the pinching pieces 51 pinch the press plate 28, the pocket cloth P and the gage plate 24 together. Therefore, even if the positions of the folding pieces 35 are roughly regulated, the distance T between the folding pieces 35 and the gage plate 4 is appropriately kept and the pocket cloth P is thus neatly folded. Therefore, the workpiece folding device for the sewing machine saves the operator the tedious task of minutely adjusting the positions of the folding pieces 35. In addition, the pocket cloth P with arch-shaped corners can be accurately margined by the workpiece folding device for a sewing machine.

It should be understood that the present device is not limited to the above-mentioned embodiment. For example, the pinching pieces 51 may be installed on the folding pieces 35 such that the pinching pieces 51 may be vertically moved.

What is claimed is:

1. A cloth folding device for a sewing machine, comprising:

cloth holding means for holding a cloth;

cloth turning means for turning an edge of the cloth over an edge of the cloth holding means to form a turned edge;

cloth folding means for folding the turned edge of the cloth underneath the edge of the cloth holding means to form a folded edge; and pinching means for applying a pinching force that holds the folded edge of the cloth around the edge of the cloth holding means, where the pinching means moves between a preparatory position away from the cloth and an operational position in which the cloth is held around the edge of the cloth holding means, and wherein additionally means are provided to increase the pinching force as the pinching means moves towards the operational position and to decrease the pinching force as the pinching means moves towards the preparatory position.

2. A cloth folding device for a sewing machine comprising:

a gage plate on which a cloth is placed;

a press plate superposed on the gage plate for folding at least one edge of the cloth along at least one folding edge of the gage plate;

a support member adjacent to the folding edge of the press plate;

at least one folding member mounted on the support member, the folding member shifting between a preparatory position apart from the gage plate and an operational position in which the folding member folds the cloth underneath the gage plate; and at least one pinching member for contacting the press plate with a pinching force that pinches the press plate, the cloth, and the gage plate between the pinching member and the folding member when the folding member is in the operational position.

3. The cloth folding device of claim 2, in which:

the press plate further comprises an inclined guide member at the point where the pinching member contacts the press plate; and the pinching member also moves between the preparatory and the operational positions; where the pinching member contacts the inclined guide member such that the pinching force gradually increases when the pinching member moves from the preparatory position to the operational position and the pinching force gradually decreases when the pinching member moves from the operational position to the preparatory position.

4. The cloth folding device of claim 3, in which the pinching member and the folding member are joined such that they move together between the preparatory and operational positions.

5. The cloth folding device of claim 4, in which the folding member is resilient.

6. The cloth folding device of claim 2, in which the gage plate has a plurality of folding edges and the cloth folding device has at least one folding member adjacent to each of the plurality of folding edges.

7. The cloth folding piece of claim 5, in which the gage plate has a plurality of folding edges and the cloth folding device has at least one folding member and at least one pinching member for each of the plurality of folding edges.

8. The cloth folding device of claim 7, in which:

the cloth is a pocket cloth to be sewn on a workpiece;

the gage plate is rectangular with two rounded corners;

the support member is a generally U-shaped piece which surrounds the gage plate such that the two rounded corners correspond with a closed end of the U-shaped support member; and five pinching members are mounted on the support member, with one pinching member and one folding member mounted on each of the sides of the support member, on the closed end of the support member, and on each intersection of the sides and the closed end of the support member.

* * * * *